US007892026B2

(12) United States Patent
Langhoff et al.

(10) Patent No.: US 7,892,026 B2
(45) Date of Patent: Feb. 22, 2011

(54) ELECTRICAL PLUG-TYPE CONNECTOR

(75) Inventors: Wolfgang Langhoff, Leonberg (DE); Michael Knödler, Gerlingen (DE)

(73) Assignee: Amphenol-Tuchel Electronics GmbH, Heilbronn (DE)

( * ) Notice: Subject to any disclaimer, the term of this patent is extended or adjusted under 35 U.S.C. 154(b) by 85 days.

(21) Appl. No.: 12/293,112

(22) PCT Filed: Jan. 18, 2007

(86) PCT No.: PCT/EP2007/000394

§ 371 (c)(1),
(2), (4) Date: Jan. 30, 2009

(87) PCT Pub. No.: WO2007/107196

PCT Pub. Date: Sep. 27, 2007

(65) Prior Publication Data

US 2009/0221181 A1 Sep. 3, 2009

(30) Foreign Application Priority Data

Mar. 17, 2006 (DE) ..... 10 2006 012 337

(51) Int. Cl.
*H01R 9/03* (2006.01)

(52) U.S. Cl. ..... 439/607.02; 439/271; 439/607.56; 439/607.47; 439/904; 439/931

(58) Field of Classification Search ..... 439/271, 439/607.02, 607.41, 607.44, 607.47, 607.56, 439/607.57, 904, 906, 931
See application file for complete search history.

(56) References Cited

U.S. PATENT DOCUMENTS 4,655,532 A 4/1987 Hillis et al.
5,046,967 A 9/1991 Majernik et al.
5,639,262 A * 6/1997 Lim ..... 439/607.38
5,895,292 A * 4/1999 Affeltranger ..... 439/607.56
6,361,356 B1 * 3/2002 Heberlein et al. ..... 439/489
6,669,511 B1 * 12/2003 Yagi et al. ..... 439/607.44
7,040,916 B2 * 5/2006 Schmidt et al. ..... 439/460
2004/0058582 A1 3/2004 Wendling et al.
2009/0221181 A1 * 9/2009 Langhoff et al. ..... 439/607.02

FOREIGN PATENT DOCUMENTS

DE 4404909 8/1994
DE 19821928 C1 1/2000
DE 69229930 T2 5/2000

(Continued)

*Primary Examiner*—James Harvey
(74) *Attorney, Agent, or Firm*—Blank Rome LLP

(57) ABSTRACT

The invention relates to an electrical plug-type connector (1) having a socket-like contact element (6), which is arranged in a contact chamber (2), which comprises at least two chamber parts (3, 4), which bear against one another with in each case at least one abutting face (24, 25), is made from plastic and has a plug-in opening (8). The invention provides for the outer face (5) of the contact chamber (2) to be completely coated with a conductive layer and for the abutting faces (24, 25) to be overlapped laterally by an overlapping wall section (27) on the outside of the contact chambers (2), and for that side of the overlapping wall section (27) which faces the abutting faces (24, 25) to likewise be coated with a conductive layer.

15 Claims, 8 Drawing Sheets

FOREIGN PATENT DOCUMENTS

Figure 1:
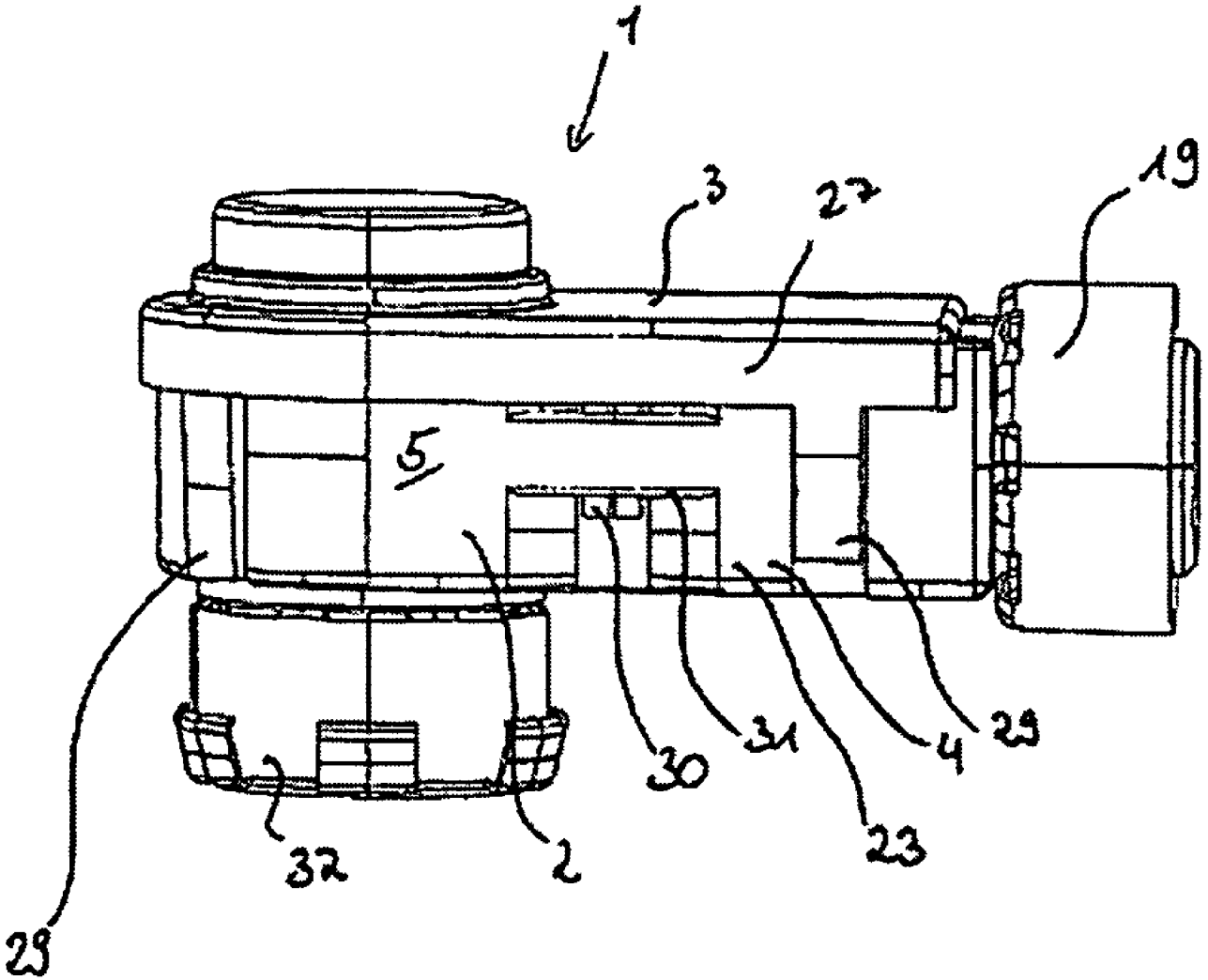

| | | | |
|---|---|---|---|
| DE | 10140685 | | 3/2003 |
| DE | 10211634 | | 10/2003 |
| DE | 10232662 | A1 | 1/2004 |
| DE | 10323616 | | 8/2004 |
| EP | 1045484 | A1 | 10/2000 |
| EP | 1544963 | | 6/2005 |
| FR | 2855330 | | 11/2004 |

* cited by examiner

ELECTRICAL PLUG-TYPE CONNECTOR

CROSS-REFERENCE TO RELATED APPLICATIONS

The present application is a National Phase of PCT/EP2007/000394, filed Jan. 18, 2007, which claims the benefit of German Patent Application No. 10 2006 012 337.9, filed Mar. 17, 2006, the entire disclosures of which are incorporated by reference herein.

The invention relates to an electrical connector according to the introductory clause of Claim 1.

An electrical connector with a socket-like contact element is known from DE 102 11 634 B4. The electrical connector is arranged in a two-part plastic housing. The two housing parts can be locked together. In the installed state, the housing parts are attached to one another on several abutting faces.

For a number of applications, in particular in the motor vehicle field, an adequate shielding of the known connectors is necessary to improve the EMC (electromagnetic compatibility). For this purpose, the known electrical connectors are generally coated with an electrically conductive, thick shell.

The object of the invention is to propose an electrical connector with a multi-part contact chamber that corresponds to the requirements of the EMC, without a coating with a thick shell having to be provided.

This object is achieved with the features of Claim 1.

Advantageous further developments of the invention are indicated in the subclaims.

The idea of the invention is to coat the outer surface of the contact chamber completely with a thin, electrically conductive layer. The layer thickness is small relative to the thickness of the contact chamber wall and is preferably less than 1 mm, preferably only a few μm. According to the invention, it is further provided to shield the abutting faces on the outside of the contact chamber with an overlapping wall section, which is also coated in a conductive manner on its side that faces the abutting faces, preferably with the same layer as the outer surface of the contact chamber. A metallization is preferably provided as a conductive layer. In other words, the overlapping wall section cuts a contact plane that receives the abutting faces in the installed state, preferably at an angle of 90°. With the overlapping wall section or the overlapping wall sections, electromagnetic waves that exit through the slits that inevitably occur between abutting faces that are attached to one another are intercepted, and this radiation is prevented from—or at least hampered in—entering the contact chamber. The overlapping wall section represents a type of labyrinth for electromagnetic radiation. In addition to the shielding function, the electrically conductive coated outer surface of the contact chamber also has the function of transferring the shielding from a connecting cable connected to the electrical connector to an interface to an application that is connected by means of the connector.

As a socket-like contact, in particular a so-called RADSOK contact, which is used in particular in high current applications, is suitable. RADSOK contacts are available as scalable components. The hyperbolic shape of the contact can ensure that contact pins can be received in a radially clamping manner.

The connectors according to the invention are suitable in particular for applications in motor vehicles, preferably for applications in motor vehicles with hybrid drives.

To further optimize the shielding for improving the EMC, it is provided in further development of the invention that the abutting faces are coated with a conductive layer, in particular made of metal. In such an embodiment, the overlapping side wall also cannot be eliminated, since slits that can act as gap antennas are created on the coated abutting faces despite good smoothness. The overlapping wall section(s) is/are used as EMC labyrinths and prevent electromagnetic waves from escaping from inside the contact chamber outward or from penetrating from the outside directly into the inside of the contact chamber.

To attach the chamber parts to one another, a locking mechanism with a flexible locking arm is preferably provided. The locking arms have locking means that can be locked with counterlocking means to another chamber part.

In addition to the design of the arm as a locking arm with locking means, the flexible arms can also be used as straps that descend into corresponding, preferably funnel-shaped receptacles in the respective other chamber part when chamber parts are plugged together. The straps are preferably also coated in an electrically conductive manner, preferably metallized, on their contact side. By the spring action, the straps press against the wall of the receptacle that is also coated in an electrically conductive manner and thus provide for an electric contact between the chamber parts and thus for a transfer of the shielding contact.

The connector is preferably provided with a collar section, through which an electrical connecting cable or the wires of the connecting cable, optionally with at least one inner insulation, are guided into the interior of the contact chamber, where they are connected in an electrically conductive manner to the contact socket. On the outside, the peripherally sealed shielding of the connecting cable is turned over the collar section with a preferably circular outside cross-section, so that the shielding of the connecting cable is connected in an electrically conductive manner to the outside of the contact chamber.

To ensure a continuous electrical connection, preferably via a peripheral angle of 360°, a sleeve that is flexible in the radial direction and that presses the shielding of the connecting cable radially inward to the outer surface of the collar section is provided in the embodiment of the invention. The sleeve preferably consists of nickel-plated brass. For reasons of economy, it is advantageous to design the sleeve as a stamped flexible part, whereby the flexing action—and thus the pressing force—is directed radially inward by straps that are separated in the peripheral direction. The straps press the shielding of the connecting cable onto the outside of the collar section.

In further development of the invention, a spring sleeve is provided with which the shielding is transferred to the interface of the application. The spring sleeve is taken up via a neck of the contact chamber and designed in such a way that it flexes both radially inward and radially outward. In this connection, straps that are flexible in the radial direction are provided on the inside periphery as well as on the outside periphery of the spring sleeve. In addition to transferring the shielding, the spring sleeve also performs the function of balancing tolerances in the interface of the application based on the flexible straps that are provided on the outer periphery. The spring sleeve is also preferably designed as a stamped flexible part, in particular from nickel-plated brass. In the installed state, the spring sleeve is arranged concentrically to the longitudinal center axis of the socket-like contact.

In addition, the subject of the invention is a housing for an electrical connector or with at least one previously described electrical connector. A modular design is achieved based on the provision of a housing for one or more electrical connectors. Thus, two-, three- or multi-pole connectors can be produced by the use of the corresponding number of previously described, in particular one-pole, connectors in a common housing. Also, the distance between the contact chambers of the connectors in the housing and thus the at-rest size can be changed in a simple way only by an adaptation of the housing. Modifications to the individual connectors are not necessary. The housing represents the suitable geometry for the application interface and is used to attach the contact chambers of the electrical connectors mechanically and to protect against environmental effects. Thus, the protection class to be achieved against environmental effects can also be selected according to the application.

In a further development of the invention, the housing consists of a cover that is sealed relative to a base part, whereby base part and cover can preferably be locked with one another.

In an embodiment of the invention, a pilot contact is to be provided. This primarily has a safety function. Via the pilot contact, a message is to be sent back to an evaluating electronic unit, which is not the subject of the invention, indicating whether the connector arranged in the housing is plugged in or not. If the connector is plugged in, the electronic unit switches the load to the connecting cable. If the connector is unintentionally disconnected, the load circuit is interrupted by the electronic unit. The electronic unit can preferably be installed in the application, in particular an electric motor or inverter. According to a simple embodiment, the pilot contact is designed as a jumper cap. This means that the circuit of the evaluating switch is closed when the connector is plugged in and is open when the connector is not plugged in.

According to an advantageous further development of the invention, radial seals with a preferably circular penetrating opening for the connecting lines are provided to seal, relative to the housing, the connecting lines that are inserted into the connecting line openings of the housing. To ensure an optimum sealing action, the radial seal has at least two sealing membranes that are separated in the axial direction to ensure a sealed extensive radial attachment to the connecting line. Should the outer sealing membranes be broken down by mechanical actions, penetrating media are prevented from entering by the second sealing membranes, etc. The sealing membranes form a labyrinth, so to speak, for the penetrating media.

The sealing action is achieved by a radial pressing of the seal; i.e., the outer diameter of the seal is larger than the diameter of the assembly opening, i.e., the connecting line opening in the housing and/or the inner diameter of the penetrating opening for the connecting line is smaller than the diameter of the connecting line.

A closing lever that can be locked with the housing is preferred for locking the operating housing. The locking lever can be rotated by a swivel joint.

Figure 2:
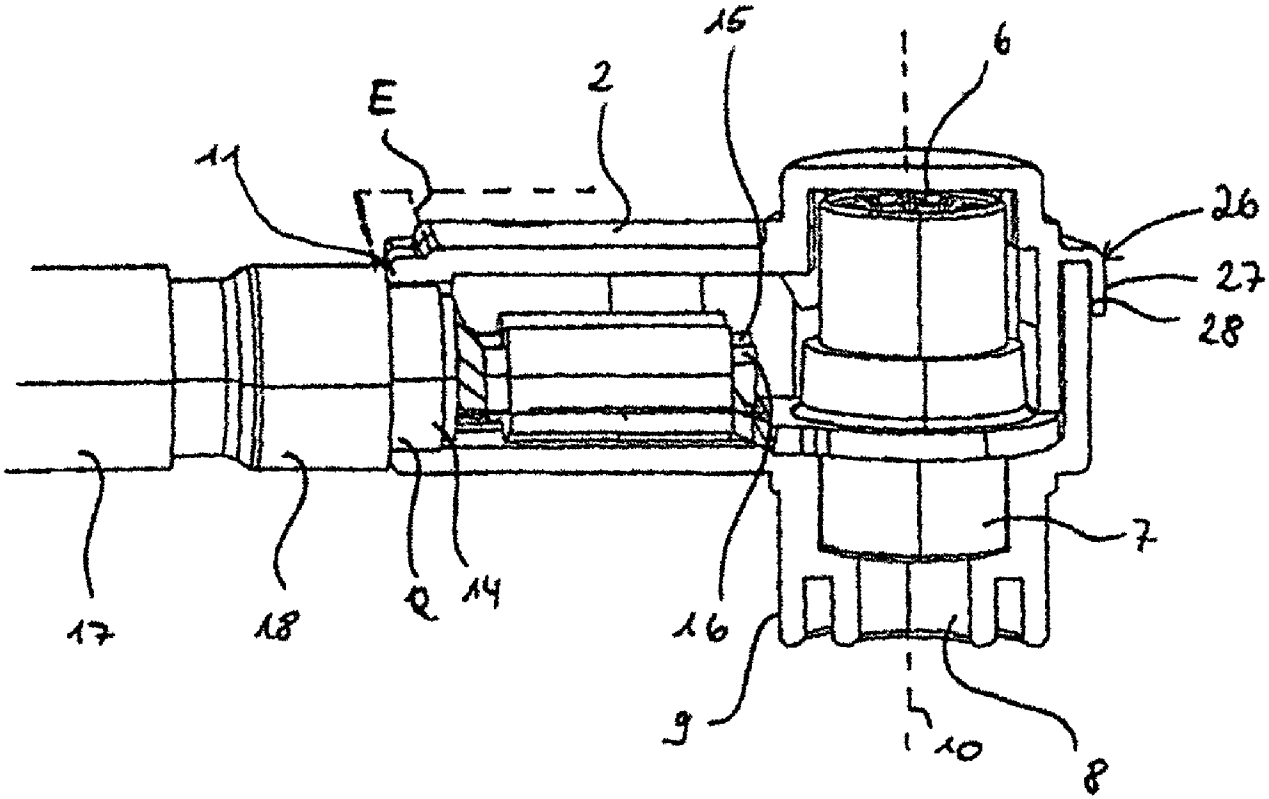
Figure 3:
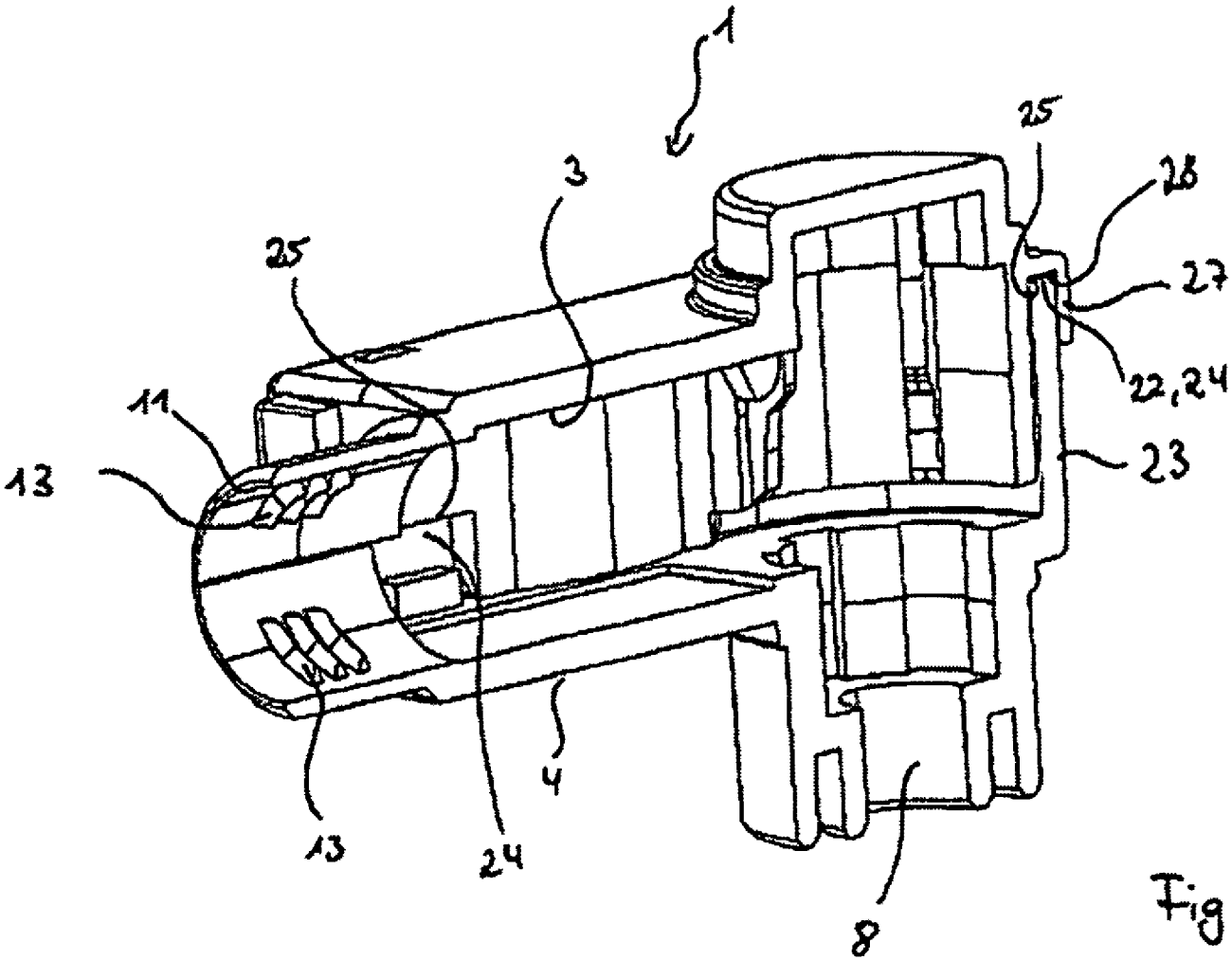
Figure 4:
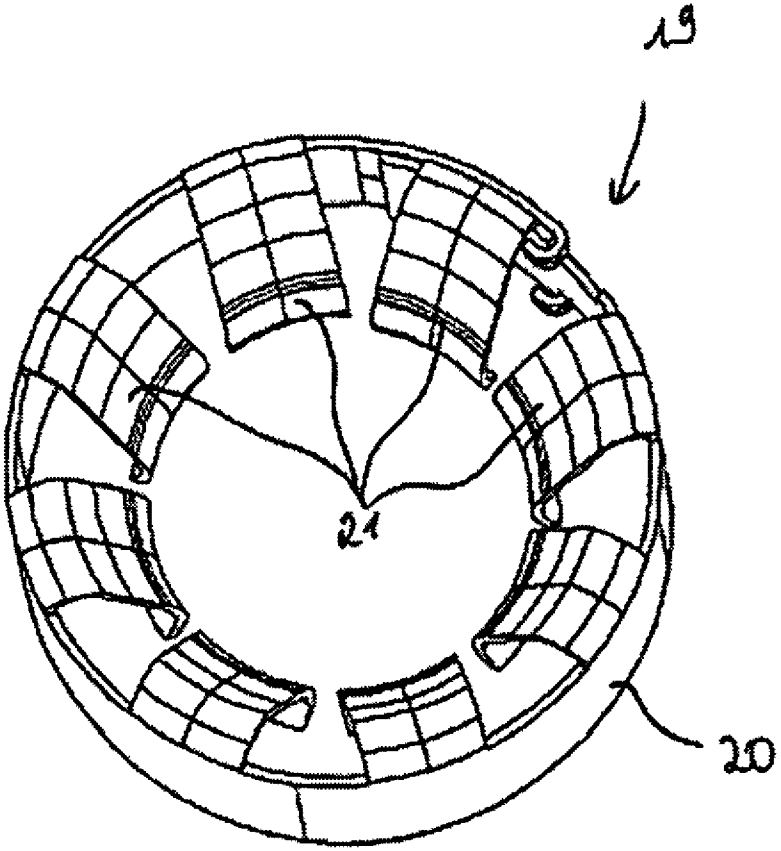
Figure 6:
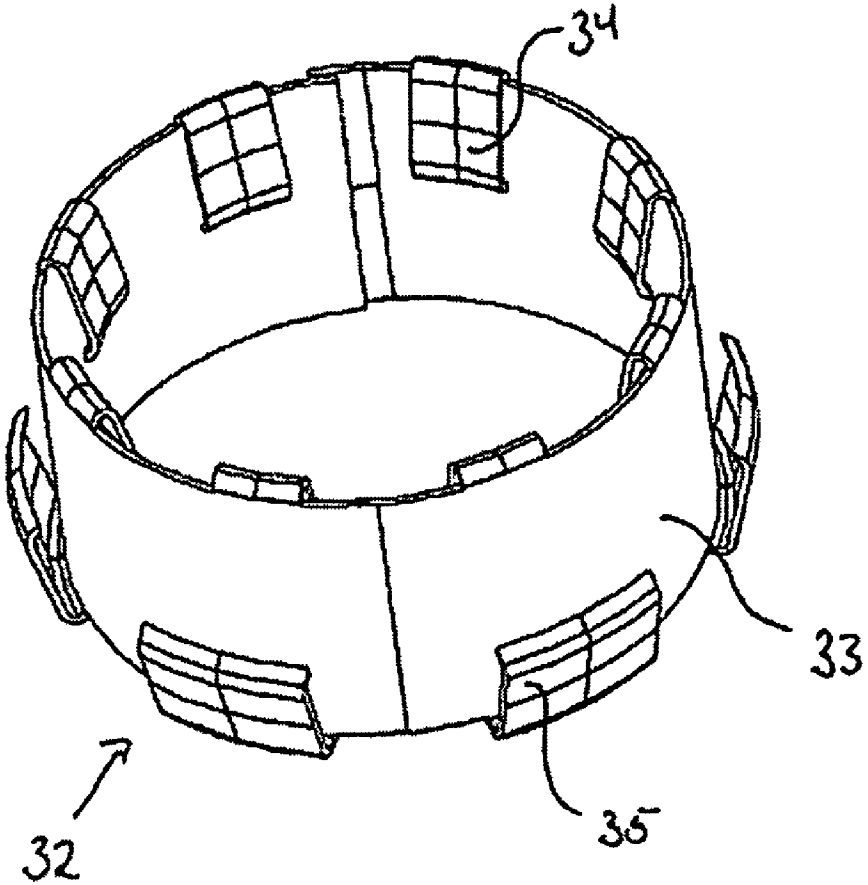
Figure 6:
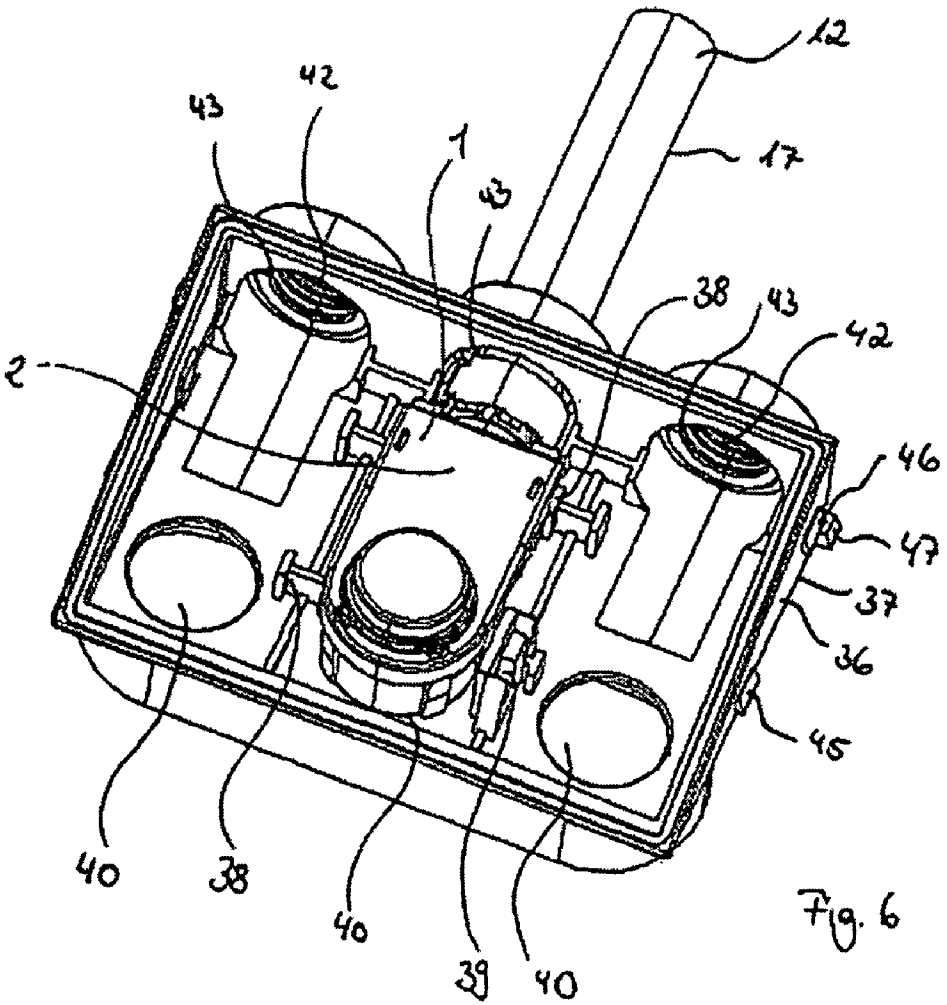
Figure 7:
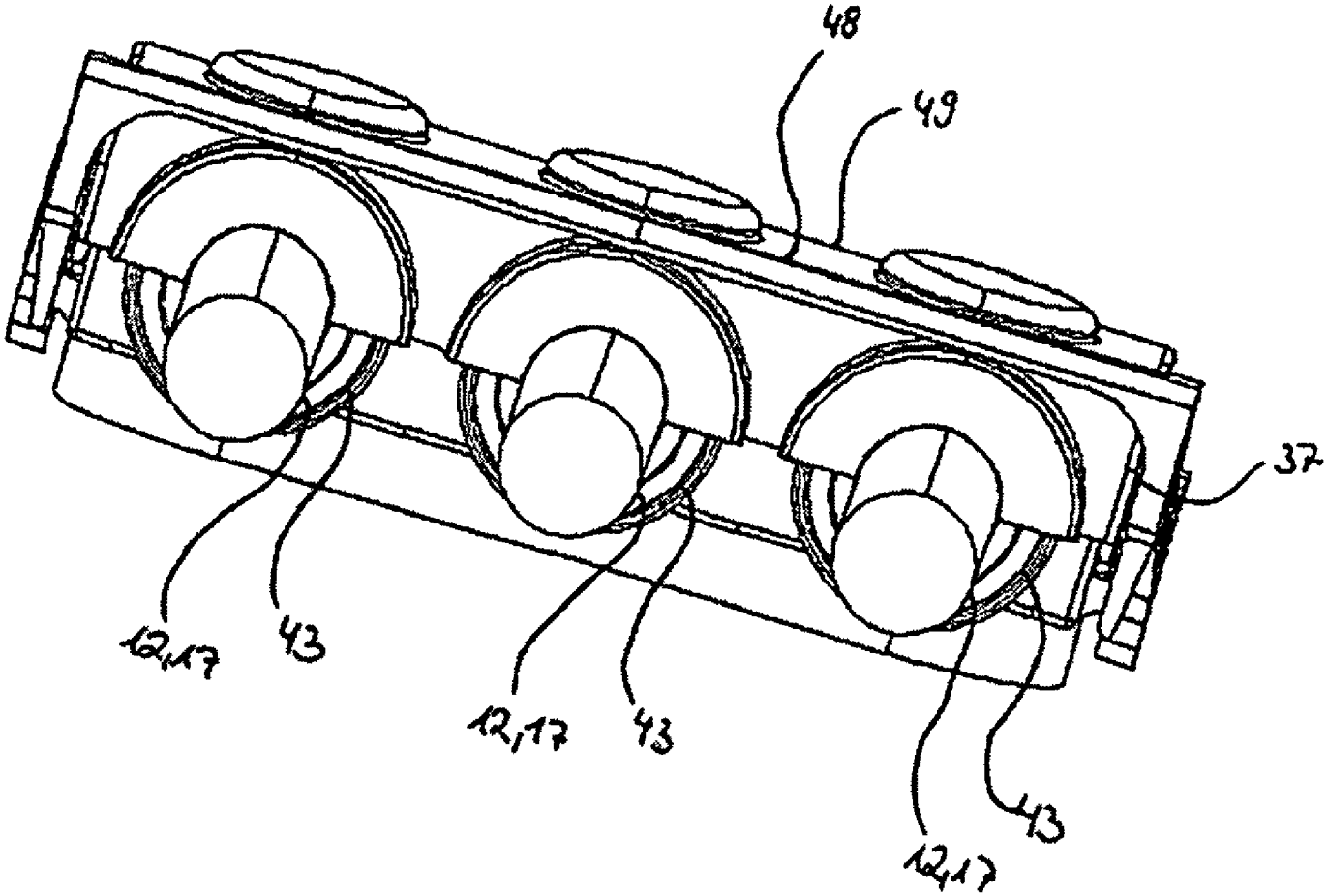
Figure 8:
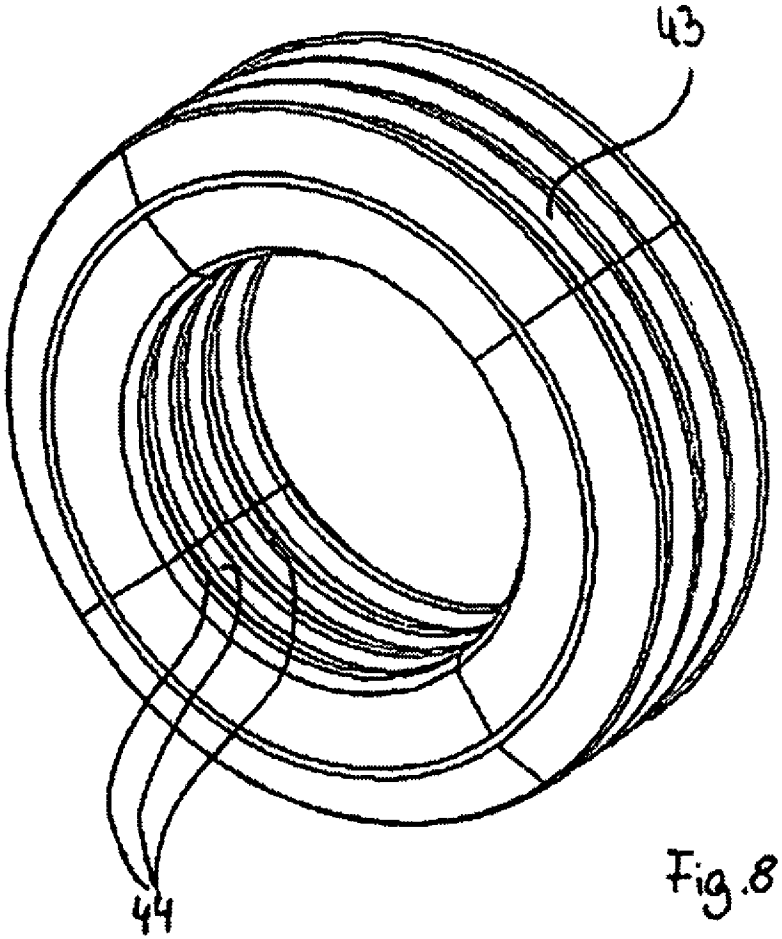

Additional advantages and suitable embodiments of the invention are explained in additional claims, the description of the figures and the drawings. Here:

FIG. 1 shows a perspective view of an electrical connector with a sleeve and spring sleeve for transferring the shielding contact, FIG. 2 shows a view of the electrical connector with a connected shielded line according to FIG. 1 with a cutaway contact chamber, FIG. 3 shows a perspective and cutaway view of the contact chamber, FIG. 4 shows a perspective view of the sleeve, FIG. 5 shows a perspective view of the spring sleeve, FIG. 6 shows the bottom of a housing for an electrical connector with an electrical connector, FIG. 7 shows a perspective rear view of the closed housing, and FIG. 8 shows a perspective view of a radial seal with several sealing membranes that are separated in the axial direction.

In the figures, the same components and components with the same function are identified with the same reference numbers.

In FIG. 1, an electrical connector 1 for high current applications in hybrid vehicles for contacting an engine or inverter is shown. The connector 1 comprises a contact chamber 2, which consists of a cover part 3 and a base part 4. The outer surface 5 of the cover part 3 and the base part 4 are coated with an extremely thin, electrically conductive layer. The latter is used for shielding a socket-like contact element 6 that is shown inside the contact chamber 2 in FIG. 2 and that is designed as a so-called RADSOK contact.

The contact chamber 2 has an insert opening 8 through which a pin-shaped plug-in contact can be inserted into the contact element 6. The insert opening 8 is arranged on the front side on a cylindrical neck section 9, which extends concentrically to the longitudinal center axis 10 of the contact element 6.

The connector 1 also comprises a collar section 11 (see FIG. 3) for inserting a connecting cable 12 (see FIG. 2). Protrusions 13 that are used to relieve the strain of the connecting cable 12 by clutching the inner insulation 14 of the connecting cable 12 are provided on the inner periphery of the collar section 11. To connect the contact element 6, the connecting cable 12 has a wire 15, 16, which rests against the crushed contour after the crimping process. A peripherally closed cable shielding 18, in particular a metal netting, is provided radially between the inner insulation 14 and an outer insulation 17. As can be seen from FIG. 2, this is fully pushed open on the collar section 11 and thus represents an electrically conductive connection to the outer surface 5 of the connector 1. The cable shielding 18 is pressed from the outside against the outside of the collar section 11 by a sleeve 19 that flexes radially inward and that is shown in the installed state in FIG. 1. Before the connecting line 12 is installed, the sleeve 19 is forced onto sail line in the axial direction and is pushed into the installed position shown in FIG. 1 after the cable shielding 18 is put on over the collar section 11. The flexible sleeve 19 that is designed as a stamped flexible part made of nickel-plated brass is shown in a perspective manner in FIG. 4. It consists of a peripheral ring 20 with flexible straps 21 that are bent radially inward, separated in the peripheral direction. The latter press the cable shielding 18 on the collar section 11.

The top 22 of the side wall 23 of the base part 4 forms a first, even abutting face 24, which rests in the installed state on a second opposing flat abutting face 25. The second abutting face 25 is designed on a section 26—L-shaped in section—of the cover part 3. The abutting faces 24, 25 go around the connector 1 almost completely. To optimize the EMC, two abutting faces 24, 25 are also provided with an electrically conductive layer.

As derived in particular from FIGS. 2 and 3, an overlapping wall section 27 is provided on the outside of the contact chamber 2 laterally from the abutting faces 24, 25, and said overlapping wall section 27 is coated with an electrically conductive layer on its inside 28, i.e., on the side facing the abutting faces 24, 25. The overlapping wall section 27 forms a leg that is arranged at a right angle to the abutting face 25 of the L-shaped section 26. The latter runs parallel to the side wall 23 of the base part 4. The overlapping wall section 27 cuts an imaginary contact plane E that receives the abutting faces 24, 25 at a right angle.

The cover part 3 and the base part 4 are locked together. In this connection, several separated locking arms 29—designed in a single part with the cover part 3—are provided with locking hooks that point inward. The locking arms 29 are made in a flexible manner and are attached to the base part 4 with their inside facing the base part 4 and provided with an electrically conductive layer. Via the inside of the locking arm 29 as well as via the abutting faces 24, 25, the electrically conductive connection between the electrically conductive coating of the cover part to the electrically conductive coating of the base part 4 is produced.

In addition, an elastic strap 30 that is designed as a single part with the cover part 3 is provided on each side of the connector 1. The straps 30 are metallized and descend into the base part 4 when the contact chamber 2 is plugged together in an electrically-conductive-coated funnel 31. By the spring action, the straps 30 press against the walls of the funnel 31 and thus provide for an electrical contact.

To transfer the shielding contact to the interface of the application, a spring sleeve 32 that, as can be seen from FIG. 1, is shifted to the neck section 9 and thus is arranged coaxially to the longitudinal center axis 10 of the contact element 6 is provided. The spring sleeve 32 is shown in detail in FIG. 5. It has an annular section 33 on which straps 34, 35 that are bent inward as well as outward are molded. With the straps 34 that are bent inward, the spring sleeve 32 clamps tightly to the neck section of the contact chamber 2 and produces the electrical contact in the outer surface 5 of the contact chamber 2. The outer straps 35 are used for the production of the shielding contact for interface of the application. Also, a balancing of tolerances in the interface is ensured by the outer straps 35 that flex in the radial direction. The spring sleeve 32 just like the sleeve 19 is preferably designed as a stamped flexible part, preferably made of nickel-plated brass.

The cable shielding 18 is thus fastened via the collar section 11 to the outer surface 5 of the cover part 3 as well as the base part 4. The shielding contact is conveyed via the spring sleeve 32 to the interface of the application. For secure attachment of the cable shielding 18 to the collar section 11, the elastic sleeve 19 is used.

In FIG. 6, a base part 36 of a housing 37 that is shown fully in FIG. 7 shows three electrical connectors 1 in this embodiment. With the assistance of the housing 37, a three-pole connector can be produced in this embodiment. By matching the housing 37, the at-rest size of the multi-pole connector can be matched to the contacting interface.

The electrical connectors 1 are inserted into the base part 36. To ensure that the connectors 1 do not rotate, the base 36 has guiding structures 38 that are attached laterally to the contact chambers and that prevent such rotation. A protrusion 39 receives a pilot contact. The guiding of the pilot contact to the point where it reaches the interface serves as a coding of the connector that consists of housing 37 and connectors 1.

In the base part 36, three separated plug openings 40 for running the neck sections 9 of the connector 1 through are provided. The area around the neck sections that project outward—and thus the interface of the application—is laterally protected by a collar section 41.

The base part 36 also has three connecting line openings 42, whereby a connecting line opening 42 is assigned to each connector 1. The cross-sectional surfaces of the connecting line openings 42 are arranged at right angles to the cross-sectional surfaces of the plug openings 40. Connecting lines 12 can be run through the connecting line openings 42. Radial seals 43 are arranged in the connecting line openings 42. Such a radial seal 43 is shown perspectively in FIG. 8. In this embodiment, the latter has four sealing membranes 44 separated in the axial direction for sealing attachment to the outer insulation 17 of the connecting line 12.

In each case, three detentes 45, 46, 47 are arranged on two opposing side areas of the base part 36. The two detentes 45, 46 are used for locking with the cover 48 shown in FIG. 7. The detente 47 is used for locking with the connecting lever 49 that is shown in FIG. 7 and that is held in a rotatable manner on the cover 48.

The sealing of the cover 48 relative to the base part 36 is carried out with sealing cord 50 arranged in a groove.

ELECTRICAL CONNECTOR LEGEND

1 Electrical Connector
2 Contact Chamber
3 Cover Part
4 Base Part
5 Outer Surface
6 Contact Element
7 Plastic Sleeve
8 Insert Opening
9 Neck Section
10 Longitudinal Center Axis
11 Collar Section
12 Connecting Line
13 Protrusion
14 Inner Insulation
15 Wire
16 Wire
17 Outer Insulation
18 Cable Shielding
19 Flexible Sleeve
20 Peripheral Ring
21 Straps
22 Top
23 Side Wall
24 Abutting Face
25 Abutting Face
26 L-Shaped Section
27 Overlapping Wall Section
28 Inside
29 Locking Arm
30 Elastic Strap
31 Funnel
32 Spring Sleeve
33 Annular Section
34 Straps
35 Straps
36 Base Part
37 Housing
38 Guiding Structures
39 Protrusion
40 Plug Opening
41 Collar Section
42 Connecting Line Openings
43 Radial Seals
44 Sealing Membranes
45 Detentes
46 Detentes
47 Detentes
48 Cover
49 Connecting Lever
50 Sealing Cord
E Contact Plane

The invention claimed is:

1. An electrical connector comprising:

a plastic contact chamber formed with an insert opening and a collar, the plastic contact chamber comprising:

a first chamber part with a first abutting face and an outer surface, the outer surface of the first chamber part being coated with an electrically conductive layer, and a second chamber part with a second abutting face, an overlapping wall section, and an outer surface, the second abutting face being in abutment contact with the first abutting face, the overlapping wall section having an inside wall that laterally overlaps the outer surface of the first chamber part, and the outer surface of the second chamber part and the inside wall of the overlapping wall section being coated with a conductive layer; and a sleeve disposed around an outside surface of the collar of the contact chamber that is configured to press a connecting cable's shielding to the outside surface of the collar.

2. The electrical connector of claim 1, wherein the first and second abutting faces are coated with a conductive layer.

3. The electrical connector of claim 1, wherein at least one flexible locking arm is attached to the outer surface of at least one of the first and second chamber parts, said locking arm being coated on its contact side with a conductive layer.

4. The electrical connector of claim 1, wherein the conductive layer is designed as a metallizing layer.

5. The electrical connector of claim 4, wherein the connector has a collar section with a circular outer cross-section that is configured to receive the connecting cable's shielding around its circumference.

6. The electrical connector of claim 5, wherein the sleeve is a radially elastic metallic sleeve.

7. An electrical connector comprising:

a socket-like contact element that is arranged in a plastic contact chamber, the contact chamber having an insert opening, comprising at least two chamber parts that are attached to one another in each case with at least one abutting face, and being characterized in that its outer surface is completely coated with a metallizing electrically conductive layer and in that the abutting faces are overlapped laterally on an outside of the contact chamber by an overlapping wall section, a side of the overlapping wall section facing the abutting faces also being coated with a metallizing electrically conductive layer;

a collar section with a circular outer cross-section configured to attach a connecting cable's shielding to the outer chamber; and a radially elastic metallic sleeve configured to press the connecting cable's shielding against the collar section, wherein flexing action of the sleeve is provided by straps that are elastic in the radial direction and that are separated in the peripheral direction.

8. The electrical connector of claim 7, further comprising an electrically conductive spring sleeve that is made of metal and flexes radially inward as well as radially outward to transfer shielding to another device.

9. The electrical connector of claim 8, wherein the spring sleeve is arranged concentrically with the longitudinal center axis of the contact element in the area of the insert opening.

10. The electrical connector of claim 8, wherein to achieve the flexing action of the spring sleeve, straps that flex in the radial direction and that are separated radially inward and outward, in each case in the peripheral direction, are provided.

11. The electrical connector of claim 1, further comprising a plastic outer housing with at least one plug opening for the connector to connect to an application interface as well as with at least one connecting line opening for running an electric connecting line through that is connected to the connector.

12. The housing of claim 11, wherein the housing comprises a cover as well as a lockable base part that is sealed by means of a circumferential seal relative to the cover.

13. The housing of claim 11, wherein at least one pilot contact is provided, via which it can be determined whether the connector is plugged in.

14. The housing of claim 11, wherein to seal the housing relative to a connecting line inserted in the connecting line opening, a radial seal with a penetrating opening for running the connecting line through is provided, and wherein the radial seal has several sealing membranes that are separated in the axial direction for sealing attachment to the connecting line.

15. The housing of claim 11, wherein a connecting lever is fastened to the housing and locks with the housing is provided.

* * * * *